US006189309B1

(12) United States Patent
Han

(10) Patent No.: US 6,189,309 B1
(45) Date of Patent: Feb. 20, 2001

(54) RUBBER AND TIRE-REINFORCING STEEL CORD EXHIBITING IMPROVED RUBBER PENETRATION

(75) Inventor: Yong Shick Han, Taejon-shi (KR)

(73) Assignee: Hankook Tire Co., Ltd. (KR)

( * ) Notice: Under 35 U.S.C. 154(b), the term of this patent shall be extended for 0 days.

(21) Appl. No.: 09/361,566

(22) Filed: Jul. 27, 1999

(30) Foreign Application Priority Data

Mar. 5, 1999 (KR) ..... 99-7249

(51) Int. Cl.[7] ..... D02G 3/36
(52) U.S. Cl. ..... 57/213; 57/230; 57/902
(58) Field of Search ..... 57/902, 212, 213, 57/230

(56) References Cited

U.S. PATENT DOCUMENTS

| | | | | |
|---|---|---|---|---|
| 4,158,946 | | 6/1979 | Bourgois | 57/213 |
| 4,947,638 | * | 8/1990 | Nagamine et al. | 57/212 |
| 4,974,654 | * | 12/1990 | Heishi | 152/451 |
| 5,285,836 | * | 2/1994 | Kawamura | 152/451 |
| 5,806,296 | * | 9/1998 | Kaneko et al. | 57/902 |

* cited by examiner

*Primary Examiner*—William Stryjewski
(74) *Attorney, Agent, or Firm*—Fish & Richardson P.C.

(57) ABSTRACT

A steel cord having a three-layer twisted construction consisting of an innermost layer, an intermediate layer, an outermost layer, and a spiral warp and being capable of achieving an improvement in the adhesion force to rubber while reducing the number of processing steps used. In the steel cord, the innermost layer consists of 3 filaments twisted in one of left or right twist directions while having a twist pitch length of 5 to 18 mm; the intermediate layer consists of 8 filaments twisted in the same twist direction as that of the innermost layer while having a twist pitch length of 5 to 18 mm, namely, the same twist pitch length as that of the innermost layer; the outermost layer consists of 13 filaments twisted in a left or right twist direction opposite to those of the innermost and intermediate layers while having a twist pitch length of 10 to 25 mm equal to or more than those of the innermost and intermediate layers; and the spiral wrap consists of a single filament adapted to be wrapped around the outermost layer, thereby preventing the steel cord from being unwound, the filament being twisted in a twisted direction opposite to that of the outermost layer while having a twist pitch length of 3 to 10 mm. Gaps are formed among the filaments of the intermediate and outermost layers. The gaps allow rubber to penetrate easily into the steel cord therethrough.

3 Claims, 1 Drawing Sheet

RUBBER AND TIRE-REINFORCING STEEL CORD EXHIBITING IMPROVED RUBBER PENETRATION

BACKGROUND OF THE INVENTION

1. Field of the Invention

The present invention relates to a rubber and tire-reinforcing steel cord exhibiting an improved rubber penetration, and more particularly to a steel cord for reinforcing tires or other rubber products which cord has a twisted construction including an innermost layer consisting of 3 filaments, an intermediate layer consisting of 8 filaments, an outermost layer consisting of 13 filaments, and a single spiral wrap while having gaps defined among the filaments of the intermediate and outermost layers and adapted to allow rubber to penetrate easily into the steel cord, thereby achieving an improvement in the penetration of rubber into the steel cord.

2. Description of the Prior Art

For rubber and tire-reinforcing steel cords structured by a plurality of twisted filaments, various constructions may be generally used. For example, steel cords having a three-layer twisted construction consisting of three twisted filament layers are known. Such steel cords having a three-layer twisted construction have been used in tires for trucks and buses.

A representative standard for a three-layer steel cord is an "1×3+9+15+W" construction. In such a three-layer steel cord having an "1×3+9+15+W" construction, a core, which is an innermost filament layer, consists of 3 filaments twisted in a certain direction. An intermediate layer, which surrounds the core, consists of 9 twisted filaments being in close contact with the core. An outermost layer, which surrounds the intermediate layer, consists of 15 twisted filaments being in close contact with the intermediate layer. A spiral wrap, which consists of a single twisted filament, surrounds the outermost layer.

The three filaments of the innermost layer are twisted together. The intermediate layer is formed by twisting 9 filaments in the same twist direction as that of the innermost layer while using a twist pitch length different from that of the innermost layer. The formation of the outermost layer is achieved by twisting 15 filaments having the same diameter as that of the intermediate layer under the condition using a twist direction opposite to that of the intermediate layer and a twist pitch length different from that of the intermediate layer. The spiral wrap is twisted in a direction opposite to that of the outermost layer.

In such a steel cord, however, there is little or no gap among the filaments of the outermost and intermediate layers. For this reason, it is difficult to allow topping rubber to penetrate sufficiently into the steel cord, thereby resulting in a degraded adhesion force to rubber. Furthermore, there may be voids among the filaments in the steel cord due to an insufficient penetration of the topping rubber into the steel cord. Such voids serve as flow passages for moisture or salt penetrating into the steel cord. When a tire, to which the steel cord is applied, is repeatedly flexed, the steel cord may be acceleratedly corroded. This results in a degradation in the durability of the tire.

Moreover, the filaments of this steel cord are in point contact or unstable line contact with each other. For this reason, the filaments of the steel cord so frictionally abrade with each other as to likely be corrosion-fatigued. Such corrosion fatigue is called "fretting fatigue". Such fretting fatigue results in a degradation in the durability of the tire. In the innermost layer and intermediate layer of the steel cord, their filaments are in unstable line contact with each other because those layers have different twist pitch lengths in spite of the same twist direction. In the case of both the outermost layer and spiral wrap, the filament or filaments of each layer are in point contact with those of the under layer because of different twist directions and different twist pitch lengths between the associated layers.

In the manufacture of such a steel cord, a twisting process is carried out for the innermost layer, intermediate layer, outermost layer, and spiral wrap, individually. In other words, four processing steps are typically involved in the manufacture of the steel cord. This results in an increase in the manufacturing costs.

SUMMARY OF THE INVENTION

The present invention has been made in view of the above mentioned problems, and, therefore, an object of the invention is to provide a steel cord for reinforcing tires or other rubber products which has a construction consisting of multi-layered twisted filaments while having gaps defined among those filaments and adapted to allow rubber to penetrate easily into the steel cord, thereby being capable of achieving an improvement in the penetration of rubber into the steel cord and a reduction in fretting fatigue, while being capable of reducing the number of twisting steps in the manufacture of the steel cord, thereby reducing the manufacturing costs.

In accordance with the present invention, this object is accomplished by providing a steel cord having a three-layer twisted construction consisting of an innermost layer, an intermediate layer, an outermost layer, and a spiral wrap, wherein: said innermost layer consists of 3 filaments twisted in one of left or right twist directions while having a twist pitch length of 5 to 18 mm; said intermediate layer consists of 8 filaments twisted in the same twist direction as that of said innermost layer while having a twist pitch length of 5 to 18 mm, namely, the same twist pitch length as that of said innermost layer; said outermost layer consists of 13 filaments twisted in a left or right twist direction opposite to those of said innermost and intermediate layers while having a twist pitch length of 10 to 25 mm equal to or more than those of said innermost and intermediate layers; and said spiral wrap consists of a single filament adapted to be wrapped around said outermost layer, thereby preventing said steel cord from being unwound, said filament being twisted in a twisted direction opposite to that of said outermost layer while having a twist pitch length of 3 to 10 mm, so that said steel cord exhibits improved penetration of rubber.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
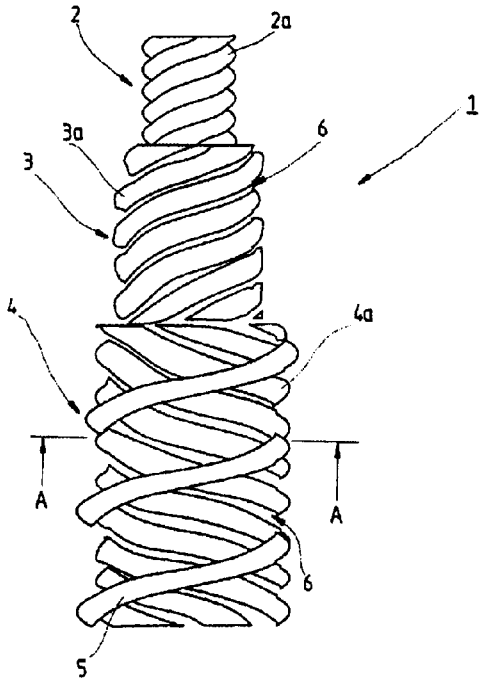
FIG. 1 is a plan view illustrating a steel cord having a "1×3/8+13+W" twisted construction according to the present invention.
Figure 2:
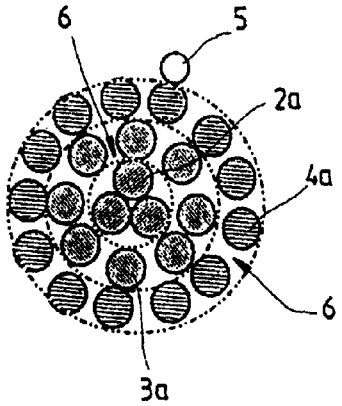
FIG. 2 is a cross-sectional view taken along the line A—A of FIG. 1.

Referring to FIGS. 1 and 2, a steel cord having a "1×3/8+13+W" twisted construction according to the present invention is illustrated, respectively. FIG. 1 is a plan view whereas FIG. 2 is a cross-sectional view taken along the line A—A of FIG. 1. As shown in FIGS. 1 and 2, the steel cord 1, which has a "1×3/8+13+W" twisted construction, has an innermost layer 2, an intermediate layer 3, an outermost layer 4, and a spiral wrap 5. The innermost layer 2 consists of 3 twisted filaments 2*a*, the intermediate layer 3 consists of 8 twisted filaments 3*a*, the outermost layer 4 consists of 13 twisted filaments 4*a*, and the spiral wrap 5 consists of a single twisted filament. That is, the steel cord 1 consists of 25 twisted filaments including the filaments 2*a*, 3*a*, 4*a* and 5.

The innermost layer 2, intermediate layer 3, outermost layer 4, and spiral wrap 5 are formed by twisting their filaments under the conditions using respective filament diameters, respective twist pitch lengths, and twist directions satisfied with the following equations:

$$0.15\ \text{mm} \leqq d1,\ d2,\ d3 \leqq 0.35\ \text{mm}$$

$$d1-0.02\ \text{mm} \leqq d2 \leqq d1+0.02\ \text{mm}$$

$$02-0.02\ \text{mm} \leqq d3 \leqq d2+0.02\ \text{mm}$$

$$d4=0.12\sim0.25\ \text{mm}$$

$p1$, $p2$=5.0~18.0 mm (Provided, $p1$ and $p2$ are the same)

$p3$=10.0~25.0 mm, and $p3 \geqq p1$, $p2$ $$p4=3.0\sim10.0\ \text{mm}$$

$k1$, $k2$, $k4$=Left or Right (Provided, $k1$, $k2$, and k4 are the same direction)

$k3$=Left or Right (Provided, $k3$ is a direction opposite to $k1$, $k2$, and $k4$)

where, "d1, d2, d3, and d4" represent respective filament diameters of the innermost layer 2, intermediate layer 3, outermost layer 4, and spiral wrap 5, "p1, p2, p3, and p4" represent respective twist pitch lengths of the innermost layer 2, intermediate layer 3, outermost layer 4, and spiral wrap 5, and "k1, k2, *k*3, and k4" represent respective twist directions of the innermost layer 2, intermediate layer 3, outermost layer 4, and spiral wrap 5.

In order to evaluate the steel cord having the above mentioned structure according to the present invention, the physical properties of a steel cord sample formed using the conditions described in Table 1 were measured along with those of a comparative sample which is a conventional steel cord having a "1×3+9+15+W twisted construction. The results obtained after the measurement are described in Table 2.

TABLE 1

| Items | Present Invention ("1 × 3/8 + 13 + W" Steel Cord) | Prior Art ("1 × 3 + 9 + 15 + W" Steel Cord) |
|---|---|---|
| Filament Diameter (mm) (IMTL/IML/OMTL/SW*) | 0.18/0.18/0.18/0.15 | 0.175/0.175/0.175/0.15 |
| Number of Filament (IMTL/IML/OMTL/SW) | 3/8/13/1 | 3/9/15/1 |
| Twist Direction (IMTL/IML/OMTL/SW) | Right/Right/Left/Right | Right/Right/Left/Right |
| Twist Length (mm) (IMTL/IML/OMTL/SW) | 10.0/10.0/16.0/5.0 | 5.0/10.0/16.0/5.0 |

*IMTL/IML/OMTL/SW: Innermost Layer/Intermediate Layer/Outermost Layer/Spiral Wrap

TABLE 2

| | Item | | Present Invention ("1 × 3/8 + 13 + W" Steel Cord) | Prior Art ("1 × 3 + 9 + 15 + W" Steel Cord) |
|---|---|---|---|---|
| Mechanical Properties | Steel Cord Diameter (mm) | | 1.33 | 1.34 |
| | Elasticity (%) (Loop Tester) | | 75 | 75 |
| | Stiffness (Q-cm/Steel Cord, TABER Stiffness tester) | | 65 | 64 |
| | Antifatigue Property (Stress: 90 kg/mm$^2$; Completely reversed cycle of stress condition using Rotating Beam Fatigue Tester) | | More than 1 million cycles | More than 1 million cycles |
| Adhesion Force to Rubber (kgf/inch) (ASTM Method) | Initial (160° C. × 20 min) | | 143 | 133 |
| | Heat Aging (100° C.) | 7 Days | 112 | 90 |
| | | 14 Days | 87 | 50 |
| | | 21 Days | 76 | 46 |
| | High Temperature and Humidity Condition (70° C. × 96% R/H) | 7 Days | 126 | 115 |
| | | 14 Days | 108 | 97 |
| | | 21 Days | 106 | 94 |
| | Salt Condition (20% NaCl) | 7 Days | 122 | 88 |
| | | 14 Days | 127 | 70 |
| | | 21 Days | 102 | 63 |

For the filaments of the "1×3/8+13+W" steel cord 1 according to the present invention, filaments are used which are made of carbon steel having a carbon content of 0.70 to 0.96% by weight. The carbon steel is subjected to a drawing process. The drawn product is then plated with brass in order to obtain an enhanced adhesion force to rubber. Finally, the resulting product is subjected again to a drawing process to produce desired filament diameters.

As shown in FIGS. 1 and 2, in the steel cord construction of the present invention, gaps 6 are formed among the filaments of the intermediate and outermost layers 3 and 4. By virtue of the gaps 6, topping rubber can penetrate into the steel cord up to the surfaces of the filaments 2*a* in the innermost layer 2. Of course, the topping rubber can easily penetrate among the filaments of the intermediate and outermost layers 3 and 4. As a result, the adhesion force of the steel cord 1 to the rubber is greatly enhanced. As apparent from Tables 1 and 2 describing the specifications and physical properties of the "1×3/8+13+W" steel cord according to the present invention and the conventional "1×3+9+15+W" steel cord, the steel cord of the present invention exhibits a superior adhesion force to rubber under severe conditions, such as conditions involving heat or salt, over the conventional steel cord. Accordingly, the steel cord of the present invention provides an improvement in the durability of tires to which the steel cord is applied.

Since the filaments 2*a* and 3*a* of the innermost and intermediate layers 2 and 3 have the same twist pitch length and the same twist direction, they are in nearly complete line contact with each other. This results in a reduction in the fretting phenomenon occurring between the innermost and intermediate layers 2 and 3. Although two twisting steps are involved in association with the conventional steel cord construction, the steel cord construction of the present invention involves only one twisting step because it uses the same twist pitch length. Such a reduction in the number of processing steps results in a reduction in the manufacturing costs.

As apparent from the above description, the present invention provides a steel cord for reinforcing tires or other rubber products which has a twisted construction including an innermost layer consisting of 3 filaments, an intermediate layer consisting of 8 filaments, an outermost layer consisting of 13 filaments, and a single spiral wrap while having gaps defined among the filaments of the intermediate and outermost layers and adapted to allow rubber to penetrate easily into the steel cord. By virtue of such a construction, the steel cord exhibits an improved adhesion force to rubber, thereby providing an improvement in the durability of tires to which the steel cord is applied. In accordance with the present invention, the filaments of the innermost and intermediate layers have the same twist pitch length and the same twist direction, they are in nearly complete line contact with each other. Accordingly, it is possible to greatly reduce the fretting phenomenon occurring between the innermost and intermediate layers of the steel cord when a tire, to which the steel cord is applied, is repeatedly flexed. Consequently, an improvement in the durability of the tire is achieved.

In accordance with the present invention, it is also possible to reduce the number of twisting steps of innermost and intermediate layers in a twisting process to one because the filaments of the innermost and intermediate layers have the same twist pitch length and the same twist direction. For the same twisting process, two processing steps are required in conventional constructions because of the use of different twist pitch lengths for the innermost and intermediate layers. Accordingly, a reduction in the manufacturing costs is achieved.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A steel cord having a three-layer twisted construction consisting of an innermost layer, an intermediate layer, an outermost layer and a spiral wrap, wherein:

said innermost layer consists of 3 filaments twisted in one of left or right twist directions while having a twist pitch length of 5 to 18 mm;

said intermediate layer consists of 8 filaments twisted in the same twist direction as that of said innermost layer while having a twist pitch length that is the same as the twist pitch length of said innermost layer;

said outermost layer consists of 13 filaments twisted in a twist direction opposite to those of said innermost and intermediate layers while having a twist pitch length of 10 to 25 mm and which is no less than those of said innermost and intermediate layers; and said spiral wrap consists of a single filament adapted to be wrapped around said outermost layer, thereby preventing said steel cord from being unwound, said filament being twisted in a twisted direction opposite to that of said outermost layer while having a twist pitch length of 3 to 10 mm, so that said steel cord exhibits improved penetration of rubber.

2. The steel cord according to claim 1, wherein said innermost, intermediate and outermost layers and said spiral wrap are satisfied with the following equations:

$$0.15\ \text{mm} \leqq d1,\ d2,\ d3 < 0.35\ \text{mm}$$

$$d1-0.02\ \text{mm} \leqq d2 \leqq d1+0.02\ \text{mm}$$

$$d2-0.02\ \text{mm} \leqq d3 \leqq d2+0.02\ \text{mm}$$

$$d4=0.12\sim0.25\ \text{mm}$$

$p1$, $p2$=5.0~18.0 mm (Provided, $p1$ and $p2$ are the same)

$p3$=10.0~25.0 mm, and $p3 \geqq p1$, $p2$ $p4$=3.0~10.0 mm $k1$, $k2$, $k4$=Left or Right (Provided, $k1$, $k2$, and $k4$ are the same direction)

$k3$=Left or Right (Provided, $k3$ is a direction opposite to $k1$, $k2$, and $k4$)

where, "d1, d2, d3, and d4" represent respective filament diameters of said innermost, intermediate, and outermost layers, and said spiral wrap, "p1, p2, p3, and p4" represent respective twist pitch lengths of said innermost, intermediate, and outermost layers, and said spiral wrap, and "k1, k2, k3, and k4" represent respective twist directions of the innermost layer, intermediate, and outermost layers, and spiral wrap.

3. The steel cord according to claim 1, wherein gaps are formed among said filaments of said intermediate and outermost layers, said gaps allowing rubber to penetrate easily into said steel cord therethrough.

* * * * *

UNITED STATES PATENT AND TRADEMARK OFFICE

CERTIFICATE OF CORRECTION

PATENT NO. : 6,189,309 B1
DATED : February 20,
INVENTOR(S) : Yong Sig Han

It is certified that error appears in the above-identified patent and that said Letters Patent is hereby corrected as shown below:

Title page,
Item [75], "Yong Shick Han" should be -- Yong Sig Han --.

Signed and Sealed this

Sixteenth Day of July, 2002

*Attest:*

*Attesting Officer*

JAMES E. ROGAN
*Director of the United States Patent and Trademark Office*